US007278720B2

(12) United States Patent
Fishbein et al.

(10) Patent No.: US 7,278,720 B2
(45) Date of Patent: Oct. 9, 2007

(54) INK CARTRIDGE WITH MULTIPLE CHAMBERS ALIGNED ALONG AN AXIAL LENGTH

(75) Inventors: Paul Fishbein, Poway, CA (US); Blair A. Butler, San Diego, CA (US); Geoffrey Schmid, San Diego, CA (US); M. Derek Patton, San Diego, CA (US); Timothy J Carlin, San Diego, CA (US)

(73) Assignee: Hewlett-Packard Develpoment Company, L.P., Houston, TX (US)

( * ) Notice: Subject to any disclaimer, the term of this patent is extended or adjusted under 35 U.S.C. 154(b) by 261 days.

(21) Appl. No.: 11/039,879

(22) Filed: Jan. 24, 2005

(65) Prior Publication Data

US 2006/0164481 A1 Jul. 27, 2006

(51) Int. Cl.
*B41J 2/175* (2006.01)

(52) U.S. Cl. ..... 347/85; 347/86

(58) Field of Classification Search ..... 347/42, 347/85, 86

See application file for complete search history.

(56) References Cited

U.S. PATENT DOCUMENTS 5,278,584 A 1/1994 Keefe
5,967,045 A 10/1999 Staiger
5,992,990 A 11/1999 Childers
6,138,076 A 10/2000 Graf
6,183,076 B1 * 2/2001 Childers et al. ..... 347/86
6,188,417 B1 2/2001 Keefe
6,247,798 B1 6/2001 Cleland
6,270,185 B1 8/2001 Askeland
6,273,560 B1 8/2001 Keefe
6,286,950 B1 9/2001 Altendorf
6,290,321 B1 9/2001 Murray
6,332,677 B1 12/2001 Steinfield
6,354,694 B1 3/2002 Weber
6,422,693 B2 * 7/2002 Pawlowski et al. ..... 347/86
6,669,319 B2 12/2003 Shimizu
6,685,307 B2 * 2/2004 Dowell et al. ..... 347/85
2002/0196317 A1 * 12/2002 Santhanam et al. ..... 347/85
2004/0085394 A1 * 5/2004 Martin ..... 347/42

* cited by examiner

*Primary Examiner*—Hai Pham
*Assistant Examiner*—Carlos A. Martinez, Jr.

(57) ABSTRACT

An ink cartridge has a first portion having a plurality of chambers formed therein; a second portion attached to the first portion and having at least one opening into each of the plurality of chambers, and wherein for each opening the second portion further includes at least a portion of a fluid directing channel; and a third portion attached to the second portion and configured to receive a plurality of fluids and direct each of the plurality of fluids into one of the respective fluid directing channels such that each of the plurality of fluids flows into a respective one of the plurality of chambers.

10 Claims, 11 Drawing Sheets

INK CARTRIDGE WITH MULTIPLE CHAMBERS ALIGNED ALONG AN AXIAL LENGTH

BACKGROUND

The present invention relates to a multiple-chambered inkjet cartridge and more specifically to an arrangement which enables the transport and regulation of multiple different and separate inks, from an inkjet printer, to separate chambers in the ink cartridge.

In prior arrangements, ink is stored in the cartridge in different chambers. However, these arrangements are such that the different chambers in the printer cartridge are not configured to support refill.

Prior solutions have found ways to transport and regulate one ink to a single chambered body. However, numerous intricacies exist in creating a printer cartridge that can transport and regulate multiple inks to a multiple chambered body.

DETAILED DESCRIPTION

An exemplary embodiment of the invention has a dual-shroud or cap which is snapped into a dual-channel crown, that sits on a dual-chambered pen body. The shroud and crown deliver two different inks from the inkjet printer to the chambers in the pen body. Inks flow into the shroud, through separate channels in the crown, and to their respective chambers in the body of the pen under regulation by the dual/tandem regulators.

This dual-chambered inkjet cartridge permits a plurality of inks to be dispensed on paper at a lower cost. For example, one cartridge can be used to dispense two or more inks or other fluids, reducing cost and/or permitting more inks to be used in the same space in a printer. Separate ink from the cartridge allows automatic refill of ink into the cartridge. Thus, the printer can run for longer intervals with larger ink supplies before running out, and when ink does run out, only the ink container needs to be replaced, not the entire cartridge. Previously, self-refillable cartridges only contained one ink.

Some of the features of the exemplary embodiments shown herein include, for example, on-axis/on-carriage regulation of two or more inks, regulation of two or more inks using internal regulator assemblies in separate chambers within the pen, transportation of two or more inks from a printer or other like printing device, through a fluid-interconnect system, to the chambers within the pen, and a system for delivering multiple off-axis/off-carriage ink supplies to one print head (e.g., one silicon die).

Figure 1:
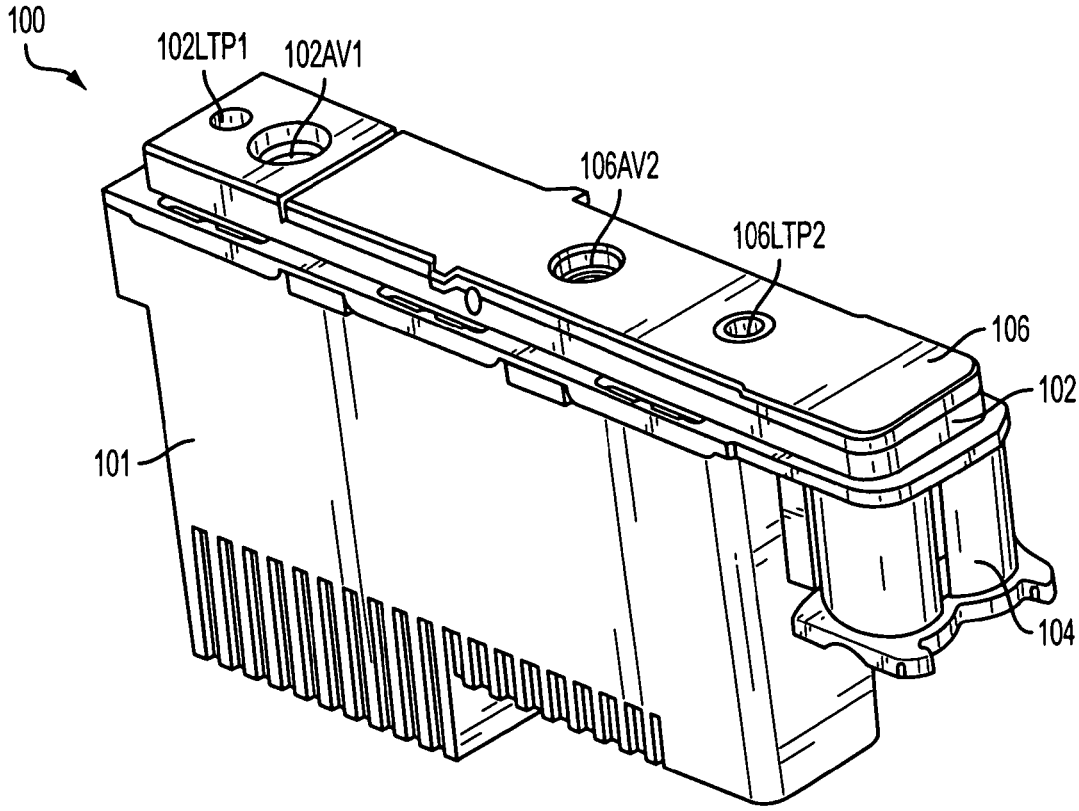
FIG. 1 is a perspective view of an embodiment of the invention in the form of an exemplary ink cartridge.
Figure 2:
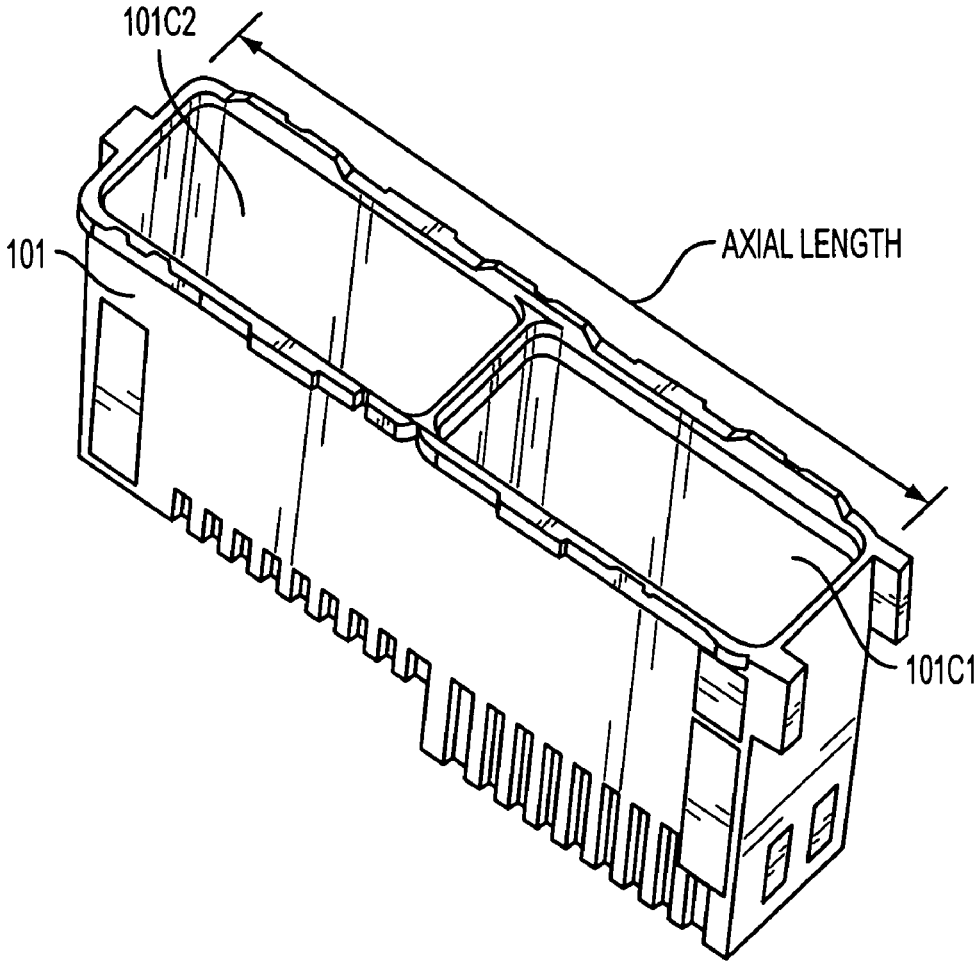
FIG. 2 is a perspective view showing an exemplary manner in which chambers are arranged in tandem in the body of the ink cartridge shown in FIG. 1.

FIG. 1 shows an exemplary embodiment of an ink cartridge 100 which includes multi-chambered pen body 101, a crown 102 which sits on the pen body 101 in a manner which closes the open mouths of the chambers (see FIG. 2). The ink cartridge 100 further includes a shroud 104 which, in this example, is integral with the crown 102 and disposed at one end thereof. A cap or lid 106 is attached on the upper surface of the crown.

Figure 3:
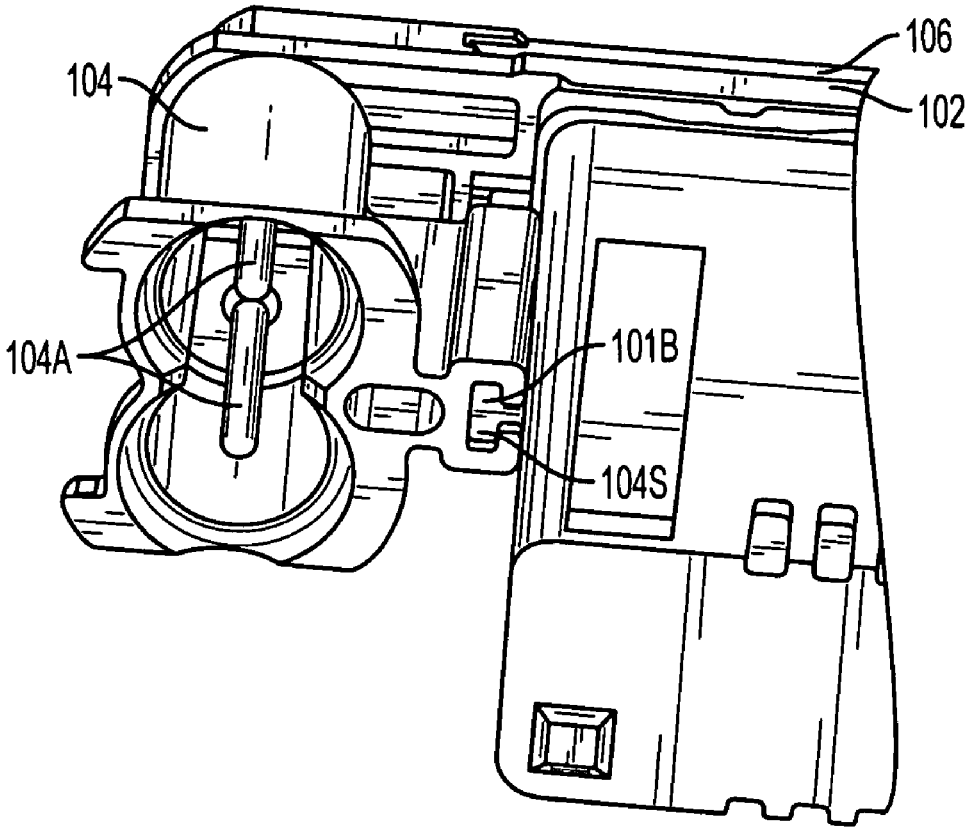
FIG. 3 is a perspective view of the shrouds and ink induction needles that are formed at one end of a crown member of the ink cartridge depicted in FIG. 1.

The shroud 104, as shown in FIG. 3, is such as to surround and enclose two elongate hollow members or needles 104A which are configured to fit into the open ends of interconnecting tubes or conduits (not shown) so as to enable ink to be received from a printer (not shown) associated with the cartridge 100. In this embodiment, the shroud 104 is formed separately from the crown 102 and then connected thereto. By way of example, shroud 104 is formed with a T-shaped slot 104S which is configured to receive a T-shaped guide member 101B which is integral with the pen body 101.

Figure 4:
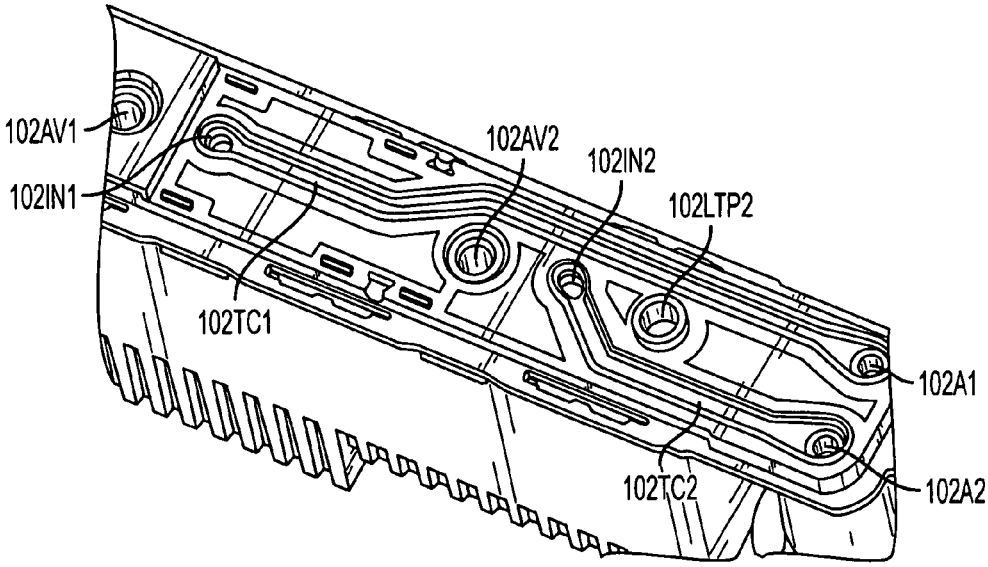
FIG. 4 is a perspective view of an upper side of an internal crown of the ink cartridge shown in FIG. 1 before the cap is disposed thereon.
Figure 5:
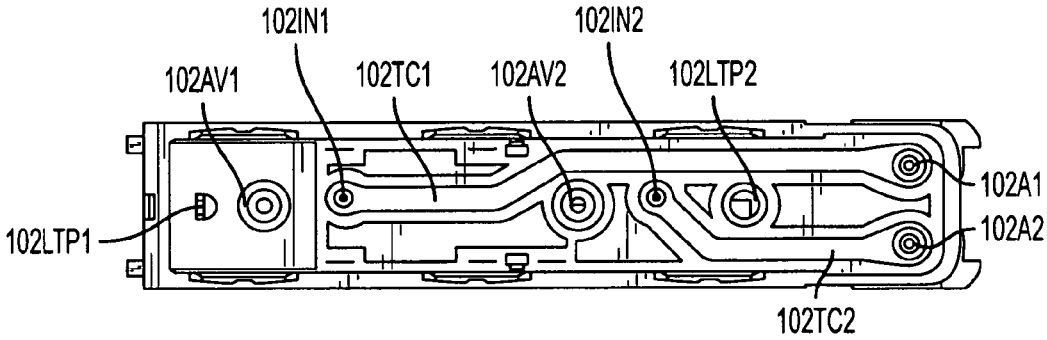
FIG. 5 is a top view showing the upper side of the crown of the ink cartridge shown in FIG. 1.

The needles 104A are arranged to fluidly communicate with a first set of ink transfer ports 102A1 and 102A2 which are formed in one end of the crown 102 as best seen in FIG. 4. These ports 102A1 and 102A2 respectively communicate with first and second ink transfer channels 102TC1 and 102TC2. As shown in this figure, channel 102TC1 is longer than 102TC2 and extends to an ink transfer port 102IN1 which is located proximate an end of the crown that is distal from the end to which the shroud 104 is connected. Ink transfer port 102IN1 is configured to communicate with the first ink chamber 101C1 (FIG. 1) which is formed in the pen body 101, when the crown 102 is disposed on the pen body 101.

On the other hand, the second ink transfer channel 102TC2 is shorter than the first, leads to an ink transfer port 102IN2 which is configured to communicate with the second ink chamber 101C2 (FIG. 2) in the pen body 101. As will be noted, the second ink transfer channel 102TC2 leads around a leak test port 102LTP2 and terminates at the ink transfer port 102IN2 which is located between the leak test port 102LTP2 and an air vent fitment 102AV2. Another air vent fitment 102AV1 is formed on a stepped portion which is located at one end of the crown 102 and thus located in the position just beyond the end of the first ink transfer channel 102TC1 and adjacent the ink transfer port 102IN1.

It should be noted that the channels 102TC1, 102TC2 are carefully routed around the features on the upper face of the crown 102 including the leak test port 102LTP2 and fitment 102AV2. For this implementation, the features are disposed between the channels so that the channel design is optimized to minimize the number of bends therein. Channel cross section may also be optimized for flow and available crown real estate.

In this embodiment, the fitments 102AV1 and 102AV2 are arranged to permit air to pass in both directions therethrough but prevent the passage of ink in either direction and thus prevent leakage of ink from the ink chambers 101C1 and 101C2. These fitments l02AV1 and 102AV2, are also associated with an arrangement that controls the supply of ink into the chambers 101C1 and 101C2. This control will be explained herein later.

Figure 9:
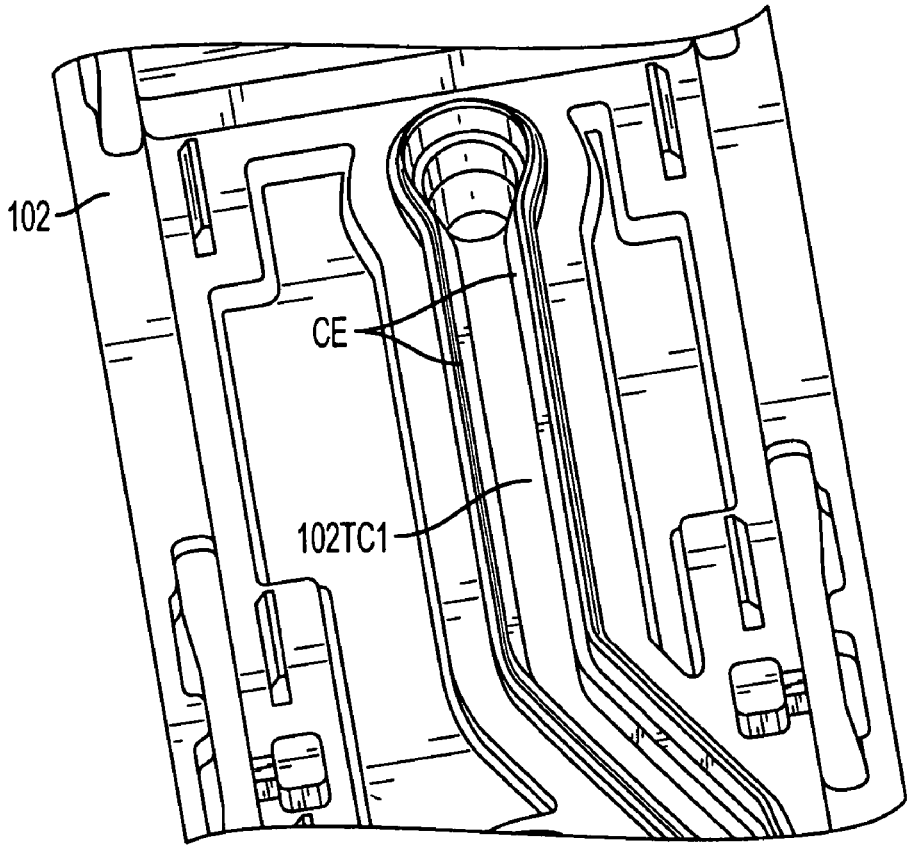
FIG. 9 is a perspective close-up view showing details of the side walls which form part of ink transfer channels formed on the upper face of the crown.
Figure 10:
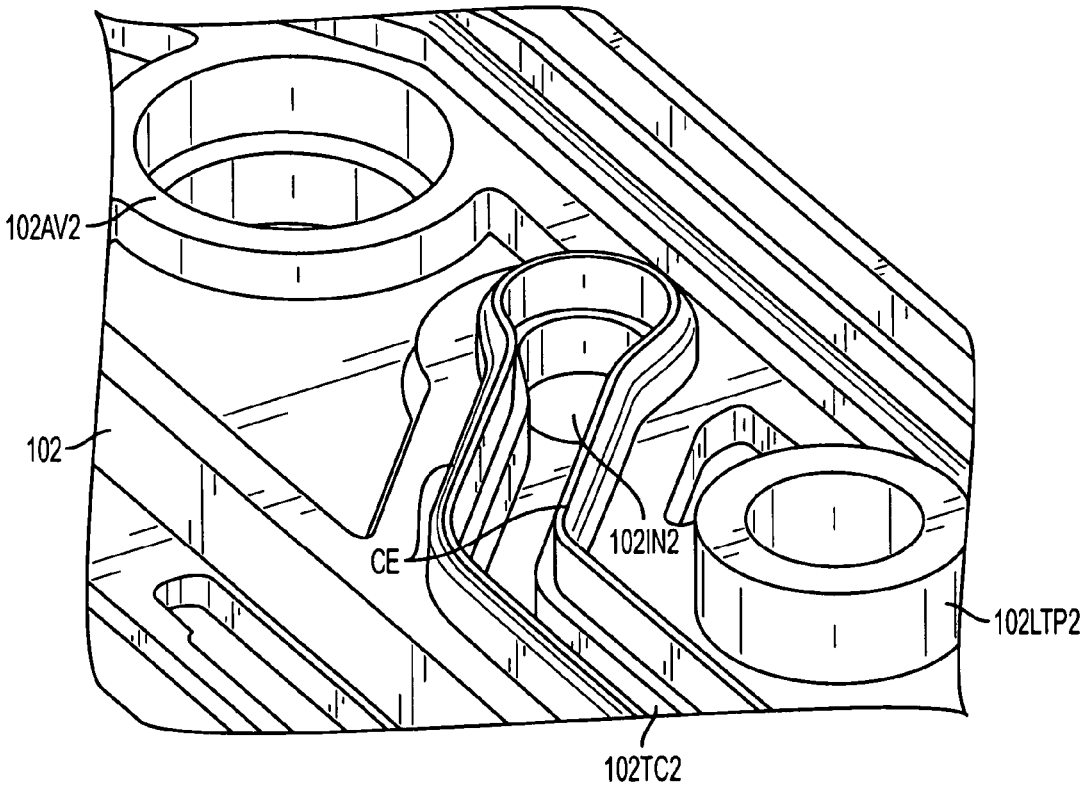
FIG. 10 is a perspective view showing details of an ink channel structure having a fitment that permits air to enter while preventing ink from escaping, and a leak test port which can be permanently sealed after successful testing for leaks.

The upper edges CE (see FIG. 9) of the channels 102TC1 and 102TC2 are arranged to extend about the upper face of the crown 102 to the degree that, when the cap 106 is attached (e.g., welded into place) on the crown 102, the lower face of the cap 106 sealingly engages the upper edges CE and thus defines separate passages through which ink can flow. The cap 106 (see FIG. 1) is also provided with ports 106AV2 which correspond to the fitment 102AV1, and with port 106LTP2 which corresponds with the leak test port 102LTP2.

As noted above, and as best appreciated from FIG. 1, the stepped portion of the crown 102 is, in this particular embodiment, such that the cap 106 leaves leak test port 102LTP1 and fitment 102AV1, uncovered.

It should also be noted that the leak test ports 102LTP1 and 102LTP2 are permanently sealed after the cartridge has been successfully tested for leaks.

Figure 6A:
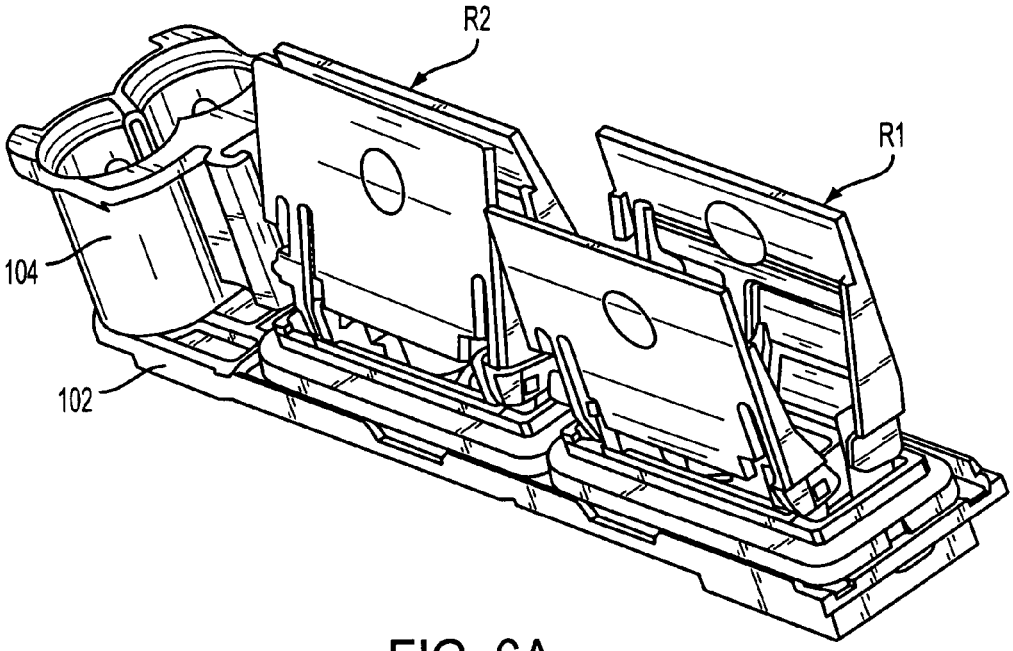
FIG. 6A is a perspective view of the underside of the crown member showing the provision of separate pairs of regulator members which control the supply of ink into the separate chambers of the ink cartridge.

The lower face of the crown 102 is, as shown in FIG. 6, provided with pairs of pivotal flap-like members which shall be referred to as regulators R1, R2. The regulators R1, R2 are pivotally supported on webs or posts 102W which are formed on the lower face of the crown 102 (see FIGS. 7 and 8). The flap-like regulators R1, R2 are arranged to extend into the ink chambers 101C1 and 101C2 when the crown 102 is seated on the pen body 101.

Each pair of pivotal members which comprise the regulators R1, R2 is provided with a valve member (not shown) which is configured to engage a structure, referred to herein as "volcano spout." Each of these volcano spouts 102VS1, 102VS2, are formed on, or otherwise fixed to the lower face of the crown 102 (see FIGS. 7 and 8) so as to form valve seats with which the valve members can engage and close off communication between the ink chambers 101C1 and 101C2 (FIG. 2) and the ink transfer ports 102IN1 and 102IN2 respectively.

The regulators R1, R2 each respond to the amount of ink in the respective ink chambers and to move in a manner which brings a valve element into engagement with a corresponding volcano spout when the associated chamber is filled to a predetermined degree with fluid.

In this embodiment, the fitments 102AV1 and 102AV2, are arranged to allow air to pass therethrough, for example, into sealed bags or bladders which are respectively disposed in the first and second ink chambers 101C1 and 101C2 between the two flap-like members of each of regulators R1 and R2. As the ink in the chambers decreases, the pressure in the chambers momentarily decreases, and air is inducted through the fitments and into the respective sealed bags to return the chamber pressure to normal. As each bag fills with air, it expands and forces regulator members apart. The regulators R1, R2 therefore open the volcano spouts and allowing ink to flow through the ink ports into the pen chambers. As ink flows in, the pressure in the respective ink chambers is increased back to nominal, causing the bags to collapse forcing back out through the fitments and allowing the regulators R1, R2 to pivot toward one another and thus close the volcano spouts.

Figure 6B:
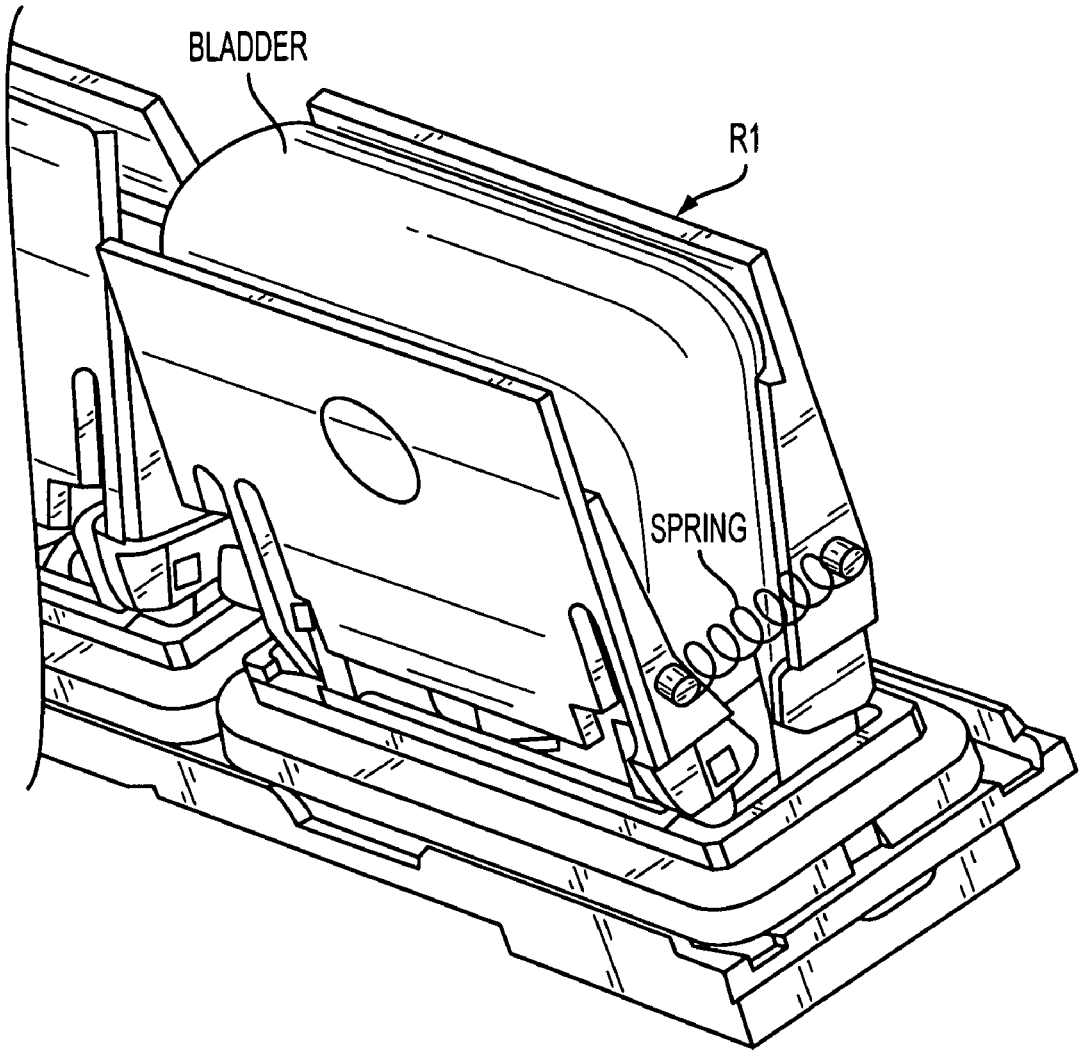
FIG. 6B is an enlarged view of the arrangement shown in FIG. 6A showing the provision of a bladder between a pair regulator members and a spring which biases the pair of regulator members toward one and other.

A biasing spring is used in the manner depicted in FIG. 6B to bias the regulators toward one another as the bags therebetween deflate and thus move the valve elements toward and into contact with the respective volcano spout closing the same. This prevents the ink chambers 101C1 and 101C2 from overfilling.

Figure 7:
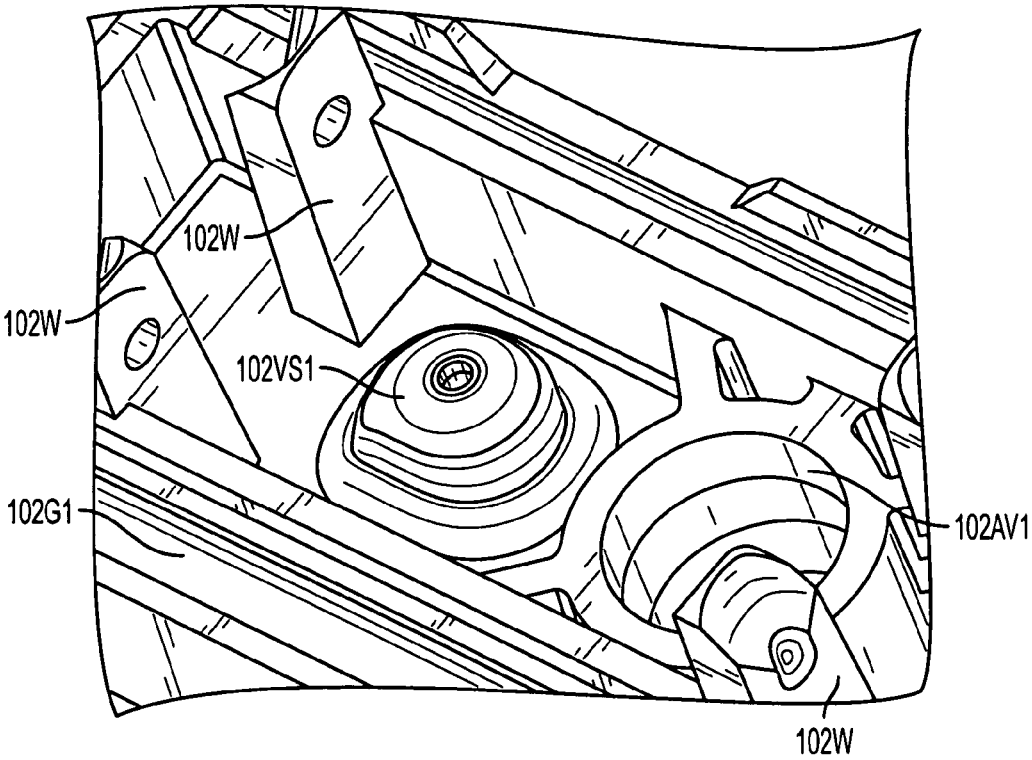
FIG. 7 is a perspective view of an exemplary valve seat which cooperates with a valve member carried on a pair of regulator members to permit passage of ink into a chamber of the ink cartridge.
Figure 8:
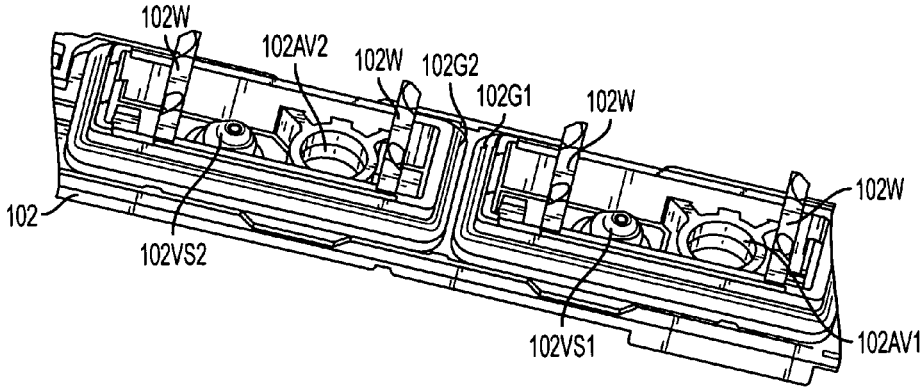
FIG. 8 is a perspective view showing the disposition of the two valve seats in a lower face of the crown along with over-molded rubber gaskets which seal the ink in respective chambers of the ink cartridge.

To seal and separate the two ink chambers 101C1 and 101C2, which are arranged in an aligned or tandem arrangement due to the elongate nature of the pen body 101, the lower face of the crown 102 is formed with two over-molded rubber gaskets 102G1 and 102G2. These are best seen in FIGS. 7 and 8.

While the invention has been described with only reference to a limited number of embodiments, it will be understood that a person skilled in the art to which the present invention pertains or most closely pertains, would be able to envisage and make various changes and modifications without departing from the scope of the present invention which is limited only by the appended claims.

What is claimed is:

1. An ink cartridge comprising:

a multi-chamber pen body;

first and second chambers aligned along an axial length of the pen body wherein the first and second chambers are configured to respectively receive and store first and second different inks;

a crown disposed on the body and configured to close and open top of the pen body and sealingly close and separate mouths of the first and second chambers, wherein the crown includes first and second ink delivery ports formed through the crown and separated along an axial length of the crown, and configured to transfer ink from the first and second channels formed in an upper side of the crown, the second channel being longer than the first channel, the first and second channels being configured to supply ink to the first and second chambers respectively and first and second ink flow regulators respectively supported on a lower side of the crown and configured to respectively extend into the first and second chambers and to regulate passage of ink through the first and second ink delivery ports in accordance with an amount of ink in the first and second chambers;

wherein the first and second channels have portions thereof that run parallel one another and extend along opposite elongate edges of the crown; and a shroud formed at one end of the crown and configured to enclosed first and second hollow needle-like members configured to respectively receive ink from first and second conduits and to transfer ink to the first and second chambers via the first and second channels respectively.

2. An ink cartridge as set forth in claim 1, wherein the first and second channels each have portions which are angled in toward a center line of the crown.

3. An ink cartridge as set forth in claim 2 further comprising:

a cap disposed on the crown to close the first and second channels and form first and second discrete passages through which ink flows from the hollow needle-like members to the chambers via the first and second ink delivery ports, respectively.

4. An ink cartridge as set forth in claim 1 further comprising:

a cap disposed on the crown to close the first and second channels and form first and second discrete passages through which ink flows from the hollow needle-like members to the chambers via the first and second ink delivery ports, respectively.

5. An ink cartridge comprising:

a multi-chamber pen body;

first and second chambers aligned along an axial length of the pen body wherein the first and second chambers are configured to respectively receive and store first and second different inks;

a crown disposed on the body and configured to close and open top of the pen body and sealingly close and separate mouths of the first and second chambers, wherein the crown includes first and second ink delivery ports formed through the crown and separated along an axial length of the crown, and configured to transfer ink from the first and second channels formed in an upper side of the crown, the second channel being longer than the first channel, the first and second channels being configured to supply ink to the first and second chambers respectively and first and second ink flow regulators respectively supported on a lower side of the crown and configured to respectively extend into the first and second chambers and to regulate passage of ink through the first and second ink delivery ports in accordance with an amount of ink in the first and second chambers, and wherein the crown includes first and second air vent fitments which are arranged in alignment with the first and second ink delivery ports, respectively; and a shroud formed at one end of the crown and configured to enclosed first and second hollow needle-like members configured to respectively receive ink from first and second conduits and to transfer ink to the first and second chambers via the first and second channels respectively.

6. An ink cartridge as set forth in claim 5, wherein the crown is formed with first and second leak test ports which are arranged in a line with the first and second air vent fitments and the first and second ink delivery ports.

7. An ink cartridge comprising:

a multi-chamber pen body;

first and second chambers aligned along an axial length of the pen body wherein the first and second chambers are configured to respectively receive and store first and second different inks;

a crown disposed on the body and configured to close and open top of the pen body and sealingly close and separate mouths of the first and second chambers, wherein the crown includes first and second ink delivery ports formed through the crown and configured to transfer ink from the first and second channels formed in an upper side of the crown, the second channel being longer than the first channel, the first and second channel being configured to supply ink to the first and second chambers respectively and first and second ink flow regulators respectively supported on a lower side of the crown and configured to respectively extend into the first and second chambers and to regulate passage of ink through the first and second ink delivery ports in accordance with an amount of ink in the first and second chambers;

a shroud formed at one end of the crown and configured to enclosed first and second hollow needle-like members configured to respectively receive ink from first and second conduits and to transfer ink to the first and second chambers via the first and second channels respectively; and a cap disposed on the crown to close the first and second channels and form first and second discrete passages through which ink flows from the hollow needle-like members to the chambers via the first and second ink delivery ports, respectively, wherein the cap has first and second air vent openings configured to respectively cooperate with third and fourth air vent openings formed in the crown, and further comprising first and second fitments, the first fitment being configured to be disposed in one of the first and third air vent openings, the second fitment being configured to be disposed in one of the second and fourth air vent openings.

8. An ink cartridge as set forth in claim 7, wherein the first and second air fitments are configured to permit air to pass therethrough but prevent the passage of ink.

9. An ink cartridge comprising:

an elongate pen body having first and second ink chambers which are aligned along an axial length of the pen body;

an elongate crown, the crown comprising:

an essentially flat surface with walls that are raised above the upper surface to form first and second discrete channels which channels each extend from an end of the crown and merge into an essentially circular wall which encloses a port that communicates with an ink chamber in the pen body, the first and second channels being configured to communicate with the first and second ink chambers respectively;

first and second vent ports in which air vent fitments are disposed, the first and second vent ports being configured to communicate with the first and second ink chambers respectively;

first and second leak test ports configured to communicate with the first and second ink chambers respectively, the first leak test port disposed between the first and second channels; and an elongate cap disposed on the crown to engages the walls and close the first and second channels to form first and second ink supply passages, and which is formed with third and fourth vent ports which are respectively aligned with and configured to communicate with the first and second air vent fitments respectively.

10. An ink cartridge as set forth in claim 9, wherein the first and second channels initially extend along each side of the elongate crown and wherein the first channel is longer than the second channel.

* * * * *

UNITED STATES PATENT AND TRADEMARK OFFICE

CERTIFICATE OF CORRECTION

PATENT NO. : 7,278,720 B2
APPLICATION NO. : 11/039879
DATED : October 9, 2007
INVENTOR(S) : Paul Fishbein et al.

It is certified that error appears in the above-identified patent and that said Letters Patent is hereby corrected as shown below:

On the Title page, in field (73), under "Assignee", in column 1, line 1, delete "Develpoment" and insert -- Development --, therefor.

In column 3, line 13, delete "102AVl" and insert -- 102AV1 --, therefor.

In column 4, line 40, in Claim 1, delete "the" before "first".

In column 5, line 22, in Claim 5, delete "the" before "first".

In column 5, line 57, in Claim 7, delete "the" before "first".

In column 5, line 60, in Claim 7, delete "channel" and insert -- channels --, therefor.

In column 5, line 61, in Claim 7, after "respectively" insert -- , --.

Signed and Sealed this

Twelfth Day of August, 2008

JON W. DUDAS
*Director of the United States Patent and Trademark Office*